US009695621B2

(12) United States Patent
Walhorn

(10) Patent No.: US 9,695,621 B2
(45) Date of Patent: Jul. 4, 2017

(54) HINGED DOOR WITH HINGE PLATE

(75) Inventor: Oliver Walhorn, Werther (DE)

(73) Assignee: DORMA DEUTSCHLAND GMBH, Ennepetal (DE)

( * ) Notice: Subject to any disclaimer, the term of this patent is extended or adjusted under 35 U.S.C. 154(b) by 0 days.

(21) Appl. No.: 13/386,870

(22) PCT Filed: Jul. 15, 2010

(86) PCT No.: PCT/EP2010/004306
§ 371 (c)(1),
(2), (4) Date: Jan. 24, 2012

(87) PCT Pub. No.: WO2011/009557
PCT Pub. Date: Jan. 27, 2011

(65) Prior Publication Data

US 2012/0117758 A1 May 17, 2012

(30) Foreign Application Priority Data

Jul. 24, 2009 (DE) ..... 10 2009 034 740
Jun. 17, 2010 (DE) ..... 10 2010 024 109

(51) Int. Cl.

| | |
|---|---|
| ***E05D 5/02*** | (2006.01) |
| ***E05F 1/12*** | (2006.01) |
| ***E05F 3/10*** | (2006.01) |
| ***E05F 3/20*** | (2006.01) |

(Continued)

(52) U.S. Cl.
CPC ..... *E05F 1/1253* (2013.01); *E05F 3/104* (2013.01); *E05F 3/20* (2013.01); *E05D 15/54* (2013.01); *E05D 2003/027* (2013.01); *E05Y 2201/21* (2013.01); *E05Y 2201/256* (2013.01); *E05Y 2201/264* (2013.01); *E05Y 2900/132* (2013.01); *Y10T 16/54* (2015.01); *Y10T 16/5402* (2015.01); *Y10T 16/5407* (2015.01)

(58) Field of Classification Search
CPC ..... E05D 5/0246; E05D 7/08; E05D 11/0246; E05D 11/1064; E05D 11/1092; E05D 7/081; E05F 3/20; E05F 3/104; A47K 3/38; E06B 11/02; E06B 3/38
USPC ..... 16/50, 54, 68, 58, 71, 78, 80, 49, 51, 16/318, 319, 280, 281, 310, 316, 317, 16/378, 252, 60, 70, 53, 59; 49/381, 397, 49/399, 339, 334, 340, 323, 324, 344, 49/137, 138; 4/610
See application file for complete search history.

(56) References Cited

U.S. PATENT DOCUMENTS

| | | | | |
|---|---|---|---|---|
| 3,028,619 A * | 4/1962 | Schlage et al. | ..... | 16/49 |
| 3,137,888 A * | 6/1964 | Blom | ..... | 16/51 |
| 4,349,939 A * | 9/1982 | Tillmann | ..... | 16/53 |

(Continued)

FOREIGN PATENT DOCUMENTS

| | | |
|---|---|---|
| CN | 101473100 A | 7/2009 |
| DE | 20 2008 013648 | 3/2009 |

(Continued)

*Primary Examiner* — Robert J Sandy
*Assistant Examiner* — Jason W San
(74) *Attorney, Agent, or Firm* — Cantor Colburn LLP

(57) ABSTRACT

A rotatably supported door including a hinge including a stationary hinge portion, a leaf hinge portion, which is pivotable about the stationary hinge portion, and a rotating shaft passing through the stationary hinge portion and the leaf hinge portion. The rotating shaft cooperates with an opening and/or closing damping device.

13 Claims, 10 Drawing Sheets

(51) Int. Cl.
*E05D 3/02* (2006.01)
*E05D 15/54* (2006.01)

(56) References Cited

U.S. PATENT DOCUMENTS 5,412,842 A * 5/1995 Riblett ..... 16/334
5,513,420 A * 5/1996 Kennedy ..... E05D 5/0246 16/252
5,867,869 A * 2/1999 Garrett et al. ..... 16/252
6,161,255 A * 12/2000 Garrett ..... 16/284
6,442,795 B1 * 9/2002 Chen ..... 16/53
6,481,055 B2 * 11/2002 Cheng ..... 16/252
6,493,904 B1 * 12/2002 Chiang ..... 16/56
6,519,811 B1 * 2/2003 Cheng ..... 16/252
6,526,627 B2 * 3/2003 Chiang ..... 16/284
6,560,821 B2 * 5/2003 Miller et al. ..... 16/252
6,704,966 B1 * 3/2004 Kao ..... 16/252
6,766,561 B1 * 7/2004 Cheng ..... 16/235
6,925,685 B2 * 8/2005 Chen ..... 16/332
7,007,341 B2 * 3/2006 Wang ..... 16/60
7,010,832 B2 * 3/2006 Chen ..... 16/252
7,114,292 B2 * 10/2006 Chiang ..... 49/388
7,188,390 B2 * 3/2007 Cheng ..... 16/252
7,305,796 B2 * 12/2007 Chiang ..... 49/388
7,305,797 B2 * 12/2007 Chiang ..... 49/388
7,421,761 B2 * 9/2008 Johnson ..... 16/60
7,900,319 B2 * 3/2011 Bacchetti ..... 16/252
7,917,994 B2 * 4/2011 Bai ..... 16/252
8,109,038 B2 * 2/2012 Houser et al. ..... 49/345
8,443,487 B2 * 5/2013 Bacchetti ..... 16/51
8,572,811 B2 * 11/2013 Lautenschlager ..... E05D 3/14 16/286
8,745,822 B2 * 6/2014 Garrett ..... E05D 5/0246 16/252
8,863,356 B2 * 10/2014 Bacchetti ..... E05F 3/104 16/252
2003/0070255 A1 * 4/2003 Huang ..... 16/60
2005/0120632 A1 * 6/2005 Chiang ..... 49/397
2005/0144757 A1 * 7/2005 Chiang ..... 16/252
2007/0256275 A1 * 11/2007 Winkler ..... 16/53
2008/0083088 A1 * 4/2008 Lin ..... E05D 11/1064 16/327
2010/0024159 A1 * 2/2010 Oh et al. ..... 16/54
2010/0275409 A1 * 11/2010 Walhorn et al. ..... 16/235
2012/0079682 A1 * 4/2012 Cheng ..... 16/252
2012/0117755 A1 * 5/2012 Walhorn ..... 16/66
2012/0117758 A1 * 5/2012 Walhorn ..... 16/321
2012/0124772 A1 * 5/2012 Bacchetti ..... 16/54
2012/0137471 A1 * 6/2012 Kujala ..... G06F 1/1681 16/382
2012/0216370 A1 * 8/2012 Chow ..... 16/54
2013/0160238 A1 * 6/2013 Cheng ..... 16/54
2013/0227814 A1 * 9/2013 Bacchetti ..... 16/54

FOREIGN PATENT DOCUMENTS

FR 1237586 A 7/1960
GB 396 889 8/1933
WO WO 2007/125524 11/2007
WO WO 2007125524 A1 * 11/2007

* cited by examiner

HINGED DOOR WITH HINGE PLATE

CROSS REFERENCE TO RELATED APPLICATIONS

This is a U.S. national stage of application No. PCT/EP2010/004306, filed on 15 Jul. 2010. Priority is claimed on German Application No.: 10 2009 034 740.2, filed 24 Jul. 2009; and German Application No.: 10 2010 024 109.1, filed: 17 Jun. 2010, the contents of which are incorporated here by reference.

BACKGROUND OF THE INVENTION

1. Field of the Invention

The invention relates to a rotatably supported door with a hinge, comprising a stationary hinge portion, a leaf hinge portion pivotable about the stationary hinge portion and a rotating shaft passing through the stationary hinge portion and the leaf hinge portion.

2. Detailed Description of Prior Art

Typically to affect the opening and closing behavior of a swing leaf door, door closers are utilized, which can be installed in the floor to be concealed, or they can be affixed visibly to a door transom. These door closers allow for an adjustable damping effect during the terminal position of the opening or closing action. These door closers may allow for functions such as hold-open or automatic closing.

Usually the majority of these door closers are suitable for only opening the swing leaf door in one direction. With double-action doors, particular measures are required to allow the door closer to function in both directions. In this case, a particular disadvantage is that, in particular with doors made from glass, the door closers are either visible, or they need to be expensively disposed in the floor, because the floor needs to be pried open to prepare the space for the door closer.

SUMMARY OF THE INVENTION

It is an object of the invention to provide a rotatably supported door with hinges, which does not present these disadvantages.

According to one embodiment of the invention, a swing leaf door is created, which is fastened to a wall, a casing or a sidewall via a hinge. The door has a hinge including an opening or closing damping device, such as to be able to forego an expensive and possibly visible door closer. In this case, the door may be fastened to the wall, the casing or the sidewall by a single hinge only. In this case, this single hinge supports the entire weight of the door and includes an integral opening or closing damping device.

According to one embodiment, the door hinge includes a hold-open or closing function and a latching device disposed at a casing and at a door closer can be foregone.

Advantageously, the door may be rotatably supported with one or more joint hinges. The hinge may be combined with another joint hinge such as to traditionally suspend the door from two hinges. In this case, the joint hinge only supports a portion of the door weight, whereas the hinge assumes the function of the opening and/or closing damping effect and/or the function of holding the opening and/or closing position.

In case of two joint hinges, the door closer, if provided, may be replaced by the inventive hinge, wherein the latter may be disposed between the joint hinges.

Another improvement is achieved if both the hinge and the functional hinge are configured as double-action hinges. This would allow for omitting a floor door closer having the double-action function. The difference between existing double-action door hinges and the inventive combination is that the double-action function is damped and the door does not pivot back and forth beyond the zero position.

According to one embodiment of the invention, the opening and/or closing damping device of the hinge is configured by at least one damper that cooperates with the rotating shaft. The damper damps the rotational movement of the door by consuming the kinetic energy, wherein, in the preferred embodiment, the damper has a piston, which, within the cylinder, moves a fluid or a gas between two pressure compartments. A very small and effective damper can be thereby provided which, on account of its structural size, is easy to incorporate into the dimensions of a hinge.

A damping function, which depends on the opening angle of the door, respectively on the deflection of the damper at the axis, is achieved on account of the eccentric disposition of the damper at the rotating shaft. At a small door opening angle, the damping effect is light and almost not noticeable for the user. At an important opening angle of the door, the damping is correspondingly higher such that the door will not pivot back and forth beyond the zero position.

In one embodiment, one end of the damper may be disposed eccentrically and articulatedly at the rotating shaft and is fastened with the other end at, respectively in the stationary hinge portion. On the one hand, the eccentric disposition of the damper at the rotating shaft allows to influence the torques and the damping paths, which in turn affects the damping effect. On the other hand, the amount of eccentricity determines the thickness of the hinge, which, from the aspect of design, should be limited.

The disposition of the one or more dampers within a damper cartridge allows for easy exchangeability of this structural component. Furthermore, graduated according to the desired damping effect, the damper cartridge may be equipped with one or more dampers. The mechanic installer or final user has the advantage that neither special tools nor expert knowledge are required to exchange a damaged damper or to adapt the system to the given circumstances with a higher damping effect. The manufacturer of the hinge has the advantage of inexpensive production, because a hinge, without requiring any structural modifications, can be equipped with different dampers, which makes the hinge usable for different door widths and door weights. Only the damper needs to be adapted to the door size.

It is particularly advantageous, if the damper cartridge has an abutment that cooperates with the rotating shaft. This arrangement has the advantage of not having to fasten each damper individually, despite the fact it is incorporated into a damper cartridge, to the rotating shaft in an expensive manner. In this case, the abutment cooperates with a cam disposed on the rotating shaft. The required eccentricity, and thereby the torque respectively the damping path, are adjusted via the cam.

The abutment may present a flat, convex, or concave abutment surface, wherein the configuration of the abutment surface may in turn increase or reduce the eccentricity. An additional variable is thus available by the configuration of the abutment surface, in order to combine a single hinge with different dampers, respectively damper cartridges for different applications.

In a preferred embodiment, the dampers are configured as closing dampers, which absorb the kinetic energy upon compression. A counter-force needs to be applied for this purpose such that the abutment is permanently pressed against the cam. In this case, an inexpensive option is to equip the damper cartridge with a compression spring that presses the abutment against the cam. It is thereby assured that the abutment and the cam are in permanent contact.

For creating a double-action door hinge, in an advantageous embodiment it is provided the hold-open function and the hold-closed function are generated by a latching device disposed at the rotating shaft. The latching device offers the possibility to maintain the door in predetermined positions such that the door does not swing back and forth, for example under wind load. It is likewise possible to keep the door open for example at an opening angle of 90°, without a potential closing function always conveying the door into the zero position or closed position.

An inexpensive structural configuration of the invention provides that the latching device is configured by a cam with a depression, which cam is disposed at the rotating shaft and the depression cooperates with a force-loaded roller. This embodiment offers the advantage of being able to utilize inexpensive standardized structural components.

The disposition of the opening and closing damping device above and/or below the latching device at the rotating shaft allows for a compact structural design of the hinge.

Another improvement is achieved if an overload protection is disposed at the abutment. Damage or destruction of the dampers is thereby avoided. In a preferred embodiment, the overload protection is configured as a leaf-spring that deforms under too important forces.

BRIEF DESCRIPTION OF THE DRAWINGS

In the following, further advantages and embodiments of the invention will be explained in detail based on several diagrammatically illustrated embodiments. In this case, the same reference numerals are utilized for the same structural components.

In the drawings.

DETAILED DESCRIPTION OF THE PREFERRED EMBODIMENTS

Figure 1:
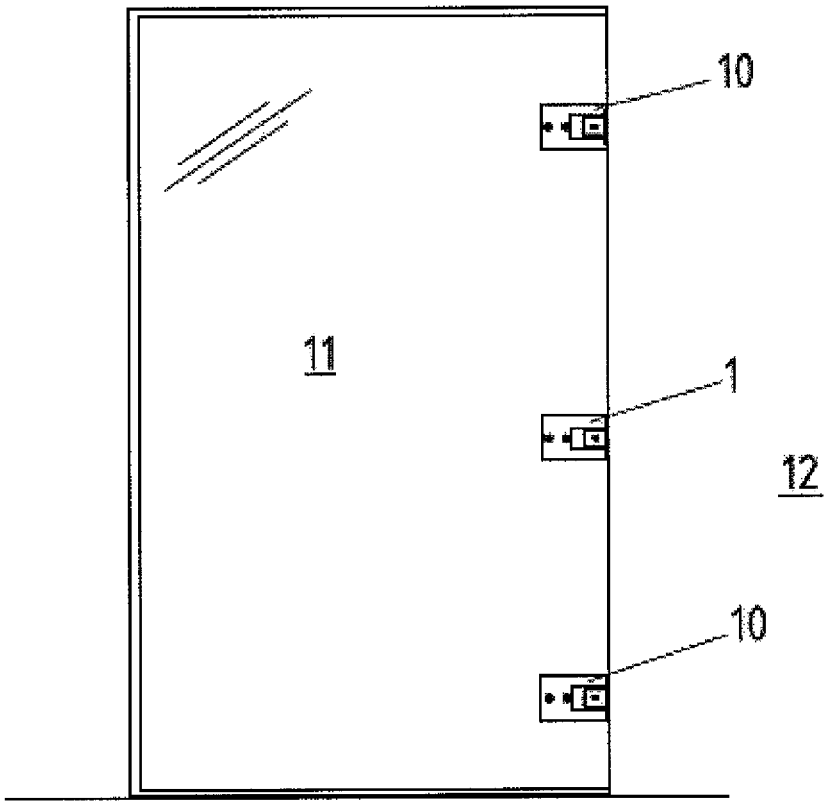
FIG. 1: is a door with hinges.

FIG. 1 illustrates a door 11, which, by a hinge 1, is disposed at a wall 12. In this case, the door 11 may be attached to the wall 12, a casing or a sidewall exclusively by a single hinge 1. As an alternative, the door 11 may be rotatably supported at a joint hinge 10 and at a hinge 1.

Another alternative is given if an existing door closer is to be replaced by a hinge 1. In this case, the door 11 is rotatably supported at two already existing joint hinges 10, between which the hinge 1 is disposed.

Furthermore, the door 11 may be configured as a double-action door such that the joint hinges 10 and the hinge 1 are configured as well as double-action door hinges. However, the door 11 may be fastened to a wall 12, a casing or a sidewall by two functional hinges 1.

Utilizing the invention, in particular with a glass door, allows for a transparent design of an all glass door system, which cannot be accomplished with conventional door closers.

Figure 2:
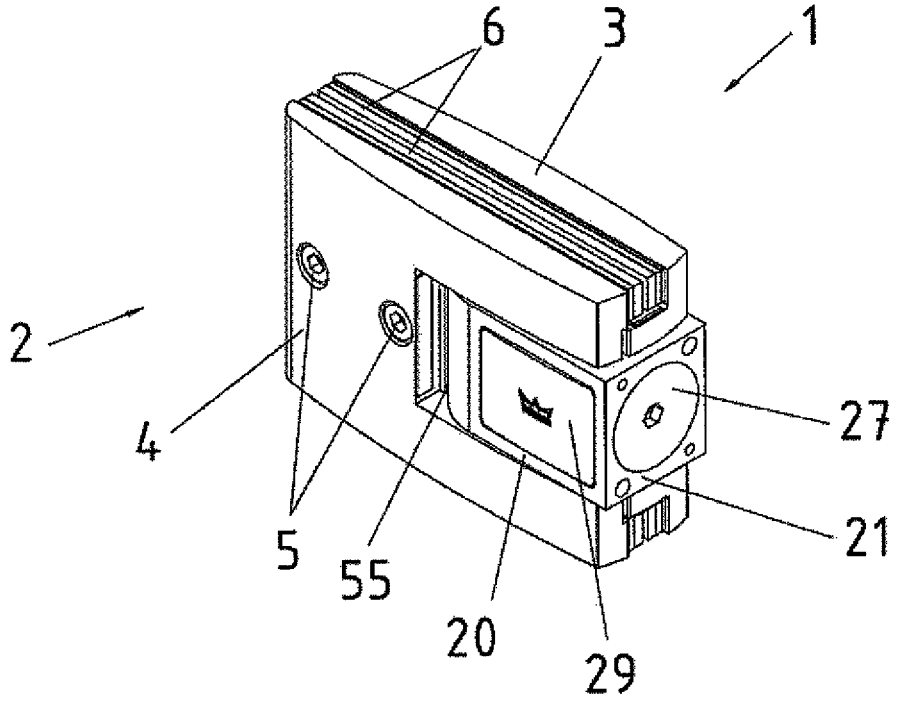
FIG. 2: is a perspective illustration of the joint hinge.

According to FIG. 2, the joint hinge 1 has a stationary hinge portion, identified here as a bearing block 20, and has a leaf hinge portion 2. An attaching plate 21, by which the joint hinge 1 is attached to a non-illustrated wall or wall structure, is attached to the bearing block 20. Instead of the bearing block 20, the joint hinge 1 may have another hinge strap to be attached to a glass pane or to a wall element.

The leaf hinge portion 2 comprises at least a first clamping plate 3 and a second clamping plate 4, which hold a non-illustrated door panel or a glass door in a clamping manner by fasteners 5. Sealing and/or damping plates 6 are disposed between the clamping plates 3, 4 and a glass pane, in order to enclose the door leaf, made from wood or glass, in the gentlest manner. Decorative covering elements 29 may be disposed on both sides of the bearing block 20. A gap 55 is located between the bearing block 20 and the clamping plates 3, 4, so that the structural components do not contact each other when operating the door. In order to avoid injuries, the frontal side of the bearing block 20, which is oriented towards the gap 55, is rounded.

Figure 3:
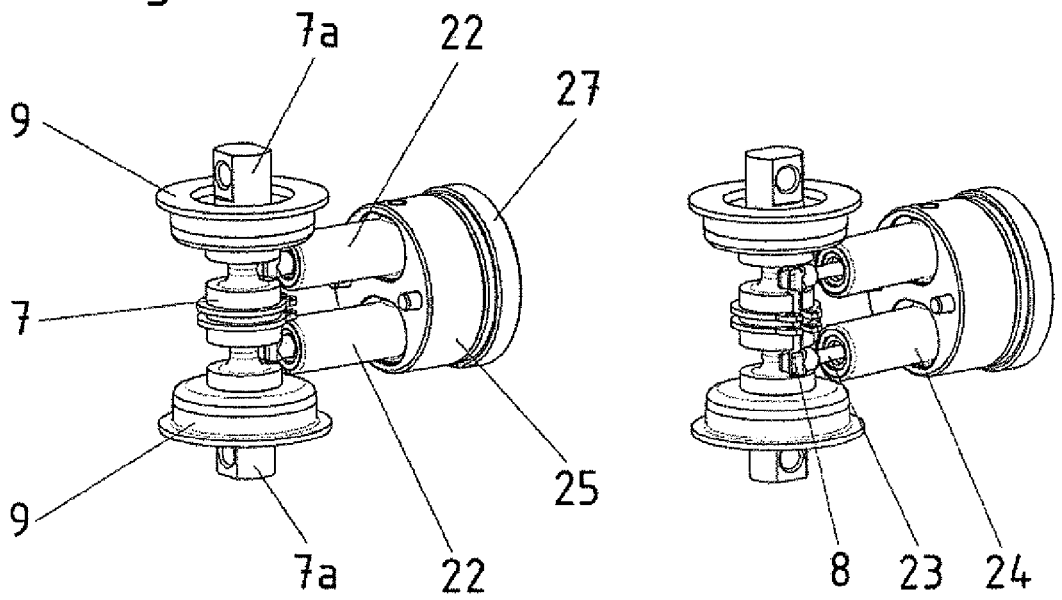
FIG. 3: is a sectional illustration of the joint hinge according to a first embodiment.
Figure 4:
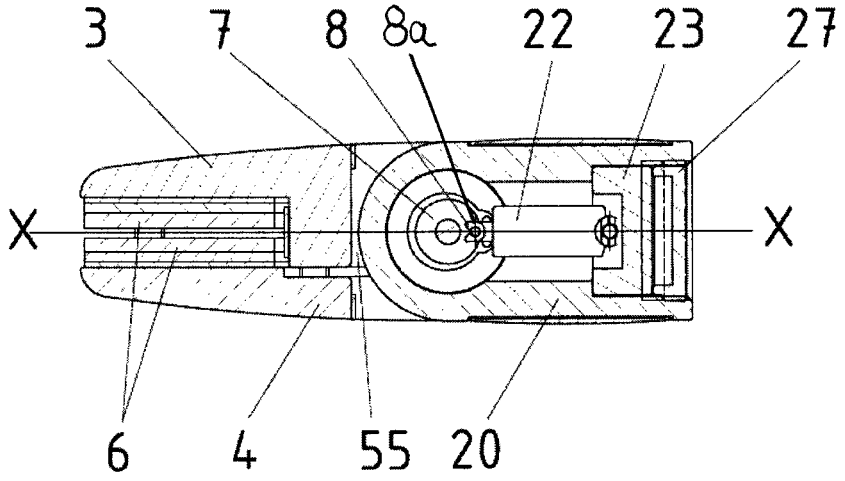
FIG. 4: is a partially sectional illustration of the joint hinge according to a first embodiment.

As illustrated in FIG. 3 and FIG. 4, a rotating shaft 7 is attached in a torque-proof manner to the first clamping plate 3. In this case, the rotating shaft 7 forms the axis of rotation or pivoting axis of the joint hinge 1. In this case, the rotating shaft 7 is attached with journals 7*a* to the first clamping plate 3 and is fixed in a torque-proof manner by fastners, for example hammer-tightened rivets or screws.

The rotating shaft 7 is fixed and supported in the bearing block 20 via the closures 9. When opening the door, the leaf hinge portion 2 rotates together with the rotating shaft 7 about the rotating shaft 7, wherein the bearing block 7 is affixed to a wall, a casing or a stationary lateral panel. A damper 22 comprises at least one piston 23 and a cylinder 24, wherein one end of the piston 23, specifically fastening portion 8*a*, is articulately and eccentrically fastened to the rotating shaft 7 via a pin 8. The other end of the piston 23 plunges into the cylinder 24. The end of the cylinder 24 is likewise articulately fastened to or in the damper reception 25. The damper reception 25 is fastened in the bearing block 20, respectively to the attaching plate 21 by a closure 27. When rotating the rotating shaft 7, the eccentrically supported pin 8 pivots about the axis of rotation of the hinge 1, such that the piston 23 moves out of the cylinder 24 and the damper 22 rotates out of the longitudinal axis, i.e. the zero position of the joint hinge X-X.

The damper 22 may be equipped with an opening and/or damping function, which effects a speed reduction in one of the terminal positions. However, the damper 22 may be equipped with an opening or closing control, whereby the door is always moved back from the opening position into the closed position or which realizes a hold-open function. For this purpose and depending on the application case, the damper 22 may be provided with an air or oil damping device, may have an eddy-current brake or a hysteresis brake.

In a preferred embodiment, the dampers 22 are configured as closing dampers such that the door is damped, when being moved into the zero position, respectively when being closed. For this purpose, the dampers 22 are conceived in that, when the piston 23 moves out of the cylinder 24, only a minor force needs to be applied so that the user can easily open the door.

When closing the door, the pistons 23 move back into the cylinder 24 and produce an important force such that the door is damped in the zero position, respectively when being closed. It is thereby guaranteed that a normal door, which travels against an abutment or a seal, will not be damaged. A double-action door is thereby prevented from opening at great momentum in the opposite direction and to swing back and forth. In this preferred embodiment, the dampers 22 are filled with a fluid or with gas which, when the damper is actuated, is moved back and forth between two pressure compartments. When utilizing valves or particularly configured seals, it is achieved that in only one direction—in this case when pulling the piston 23 out of the cylinder 24—the fluid or the gas is displaced at low resistance between the pressure compartments, whereas a large resistance is generated in the other direction.

Each rotation or actuation of the door about the rotating shaft 7 of the hinge 1 results in this case in an outstroke of the piston 23 out of the cylinder 24, wherein the damper 22, on account of the eccentric disposition at the rotating shaft 7, moves out of the longitudinal axis X-X. In this embodiment, two dampers 22 are disposed vertically above each other in the bearing block 20. However, only one damper 22 or, depending on the available space, several dampers 22 may be disposed therein. As an alternative, the dampers 22 may be disposed next to each other; however, the hinge 1 would become thicker.

In this embodiment, the hinge is configured as a double-action door hinge, in which the door 11 may be opened in both directions. An arbitrary mechanical opening limitation at the rotating shaft 7 may protect the dampers 22 from being damaged. This hinge 1 may be utilized as a normal hinge for doors with an abutment, wherein, even for this application case, a mechanical opening limitation may be provided.

The rotating shaft 7 may be configured as one part or multipart. In this embodiment, the rotating shaft 7 is configured as one part, wherein the rotating shaft 7 has depressions for receiving the pistons 23. FIG. 4 reveals again the gap 55 between the clamping plates 3, 4 and the bearing block 20. The rounded frontal edge of the bearing block 20 helps minimize the risk of squeezing and pinching.

Figure 6:
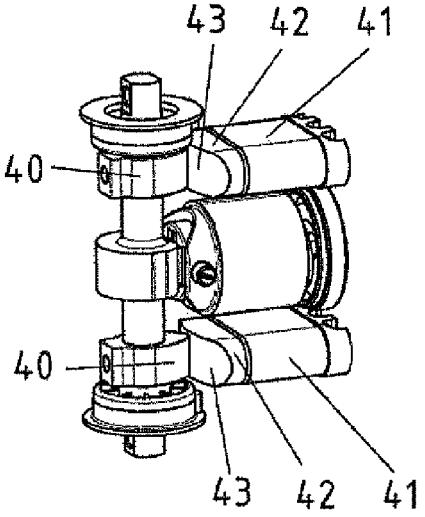
FIG. 6: is a perspective view of a second embodiment.
Figure 5:
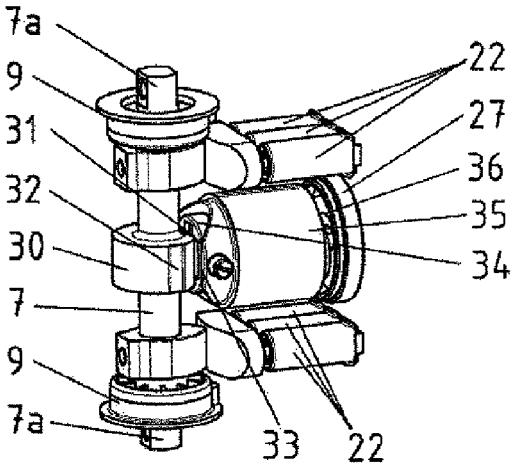
FIG. 5: is a perspective view of a second embodiment.
Figure 7:
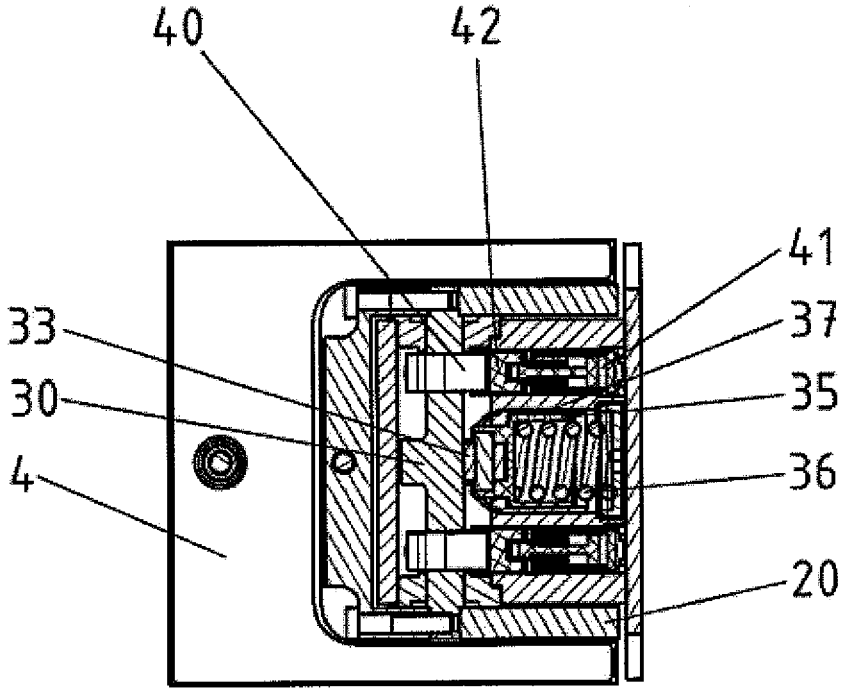
FIG. 7: is a sectional illustration of the second embodiment.

In the second embodiment according to the FIGS. 5, 6 and 7, a latching device is combined with the above described damping device. A latching device in a double-action door hinge has the function of keeping the door in a predetermined opening position, e.g. at a 90° door opening angle and/or to reliably close the door and to position it in the zero position. For this purpose, the latching device has at least one cam 30, which is disposed on the rotating shaft 7 and has a counter-pressure device, for example in the shape of a roller 33, which is pressed against the cam 30 by a spring 36. In this embodiment, the cam 30 cooperates with a roller 33, wherein, when operating the hinge 1, the surfaces of the cam 30 and of the roller 33 roll on each other. A depression 31 is disposed in the cam 30, which depression is able to receive, at least partially, a segment of the circle of the roller 33. Furthermore, one more or several more recesses 32, which likewise cooperate with the roller 33, may be disposed on the circumference of the cam 30.

The cam 30 may be configured with the rotating shaft 7 as one part or multipart. In this embodiment, the cam 30 is configured with the rotating shaft 7 as one part, wherein the cam 30 is integrally connected to the rotating shaft 7.

The roller 33 is rotatably supported at a roller piston 34 by means of a non-illustrated bolt. The roller piston 34 in turn is disposed to be movable in axial direction in an adjusting cylinder 35. A force is acting against the roller piston 34 in axial direction such as to press the roller 33 against the cam 30. The force may be applied by a spring 36 or hydraulically or pneumatically. In this embodiment, the roller piston 34 is configured as a pot on one side, into which the spring 36 engages, at least partially, and is guided therein. In this case, the spring 36 is supported at a closure 27, which is disposed at or in the attaching plate 21 and is attached thereto.

In the zero position of the door, the roller 33 is located in the depression 31 of the cam 30. As the bearing block 20 is attached to a wall via the attaching plate 21, the clamping plates 3, 4 rotate together with the door about the rotating shaft 7 of the hinge 1, when opening the door. As the rotating shaft 7 is disposed in a torque-proof manner within the first clamping plate 3 via the attaching element 9, the rotating shaft 7 rotates within the bearing block 20, wherein the cam 30, with its surface, rolls on the surface of the rotatably disposed roller 33. In this case, the roller 33, together with the roller piston 34, is pressed against the spring 36 and leaves the depression 31 during this rotary movement. Another recess 32 may be disposed at a 90° angle with regard to the depression 31, such that the door stops at this intermediate position. This one and also several latching recesses 32 may be disposed and distributed in an arbitrary number on the cam 30, depending on the intermediate positions, in which the door is supposed to stay open. If the door is closed with momentum, the rotating shaft 7 rotates with the cam 30, until the roller 30 reaches the depression 31 again. In this case, depending on size of the spring force, the cam 30 with the depression 31 swings back and forth several times, wherein, in this case, the roller 33 passes the depression 31 of the cam 30, until the momentum of the spring force and of the damper 22 is more important than the remaining torque of the door.

The one or more dampers 22 according to this second embodiment is/are essentially disposed in a damper cartridge 41, which has an abutment 42 with an abutment surface 43, wherein the abutment surface 43 cooperates with a cam 40. In this embodiment, respectively one damper cartridge is disposed above and one below the latching device. However, depending on the application, it may be possible that only one damper cartridge be disposed next to the latching device. Also the disposition of the damper cartridges 41 at the rotating shaft 7 may be arbitrary. The damper cartridge 41 may receive at least one or several dampers 22, wherein, in a preferred embodiment, the cylinders 24 of the dampers are coated with or encased in plastic material. An abutment 42 is connected to the pistons 23 of the dampers 22. The abutment may have a flat, convex or concave abutment surface 43, which cooperates with the surface of the cam 40. In this case, the geometry of the abutment surface 43 depends on the desired damping effect. As the dampers 22 function as closing dampers, the abutment 42 needs to be pressed against the cam 40 against the damping force. This is accomplished by one or more springs 45, which press the abutment surface 43 against the surface of the cam 40. When closing the door, the roller 33 of the latching device latches with the depression 31 of the cam 30. So that the door does not swing back and forth all the time until the kinetic energy of the door is consumed, the one or more dampers dampen the rotational movement of the door in such a way that the roller 33 of the latching device can not leave the depression 31 of the cam 30. The door therefore remains in the zero position.

Figure 8:
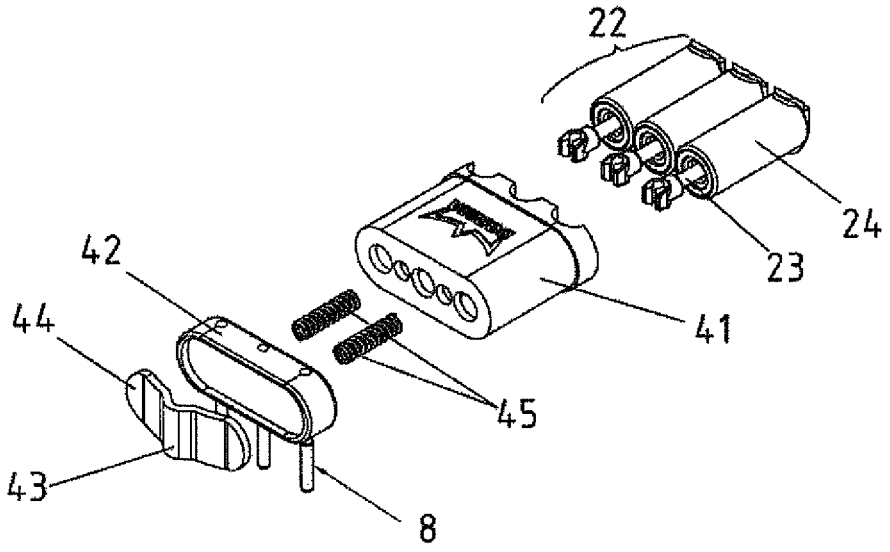
FIG. 8: is a perspective view of a damper cartridge.

The disposition of the dampers 22 in a damper cartridge 41 is illustrated again in FIG. 8. In this embodiment three dampers 22 are illustrated together with their pistons 23 and cylinders 24, which are inserted into a damper cartridge 41. The connection between the abutment 42 and the dampers 22 is realized via pins 8. Springs 45, which allow the pistons 23 to travel out of the cylinders 24, are disposed between the abutment 42 and the damper cartridge 41. In this embodiment, an overload protection 44 is disposed at the frontal side on the abutment 42, the abutment surface 43 thereof cooperating with the cam 40. The overload protection 44 prevents the dampers 22 from being destroyed should the door 11 be operated at too high a force. The overload protection 44 is configured in this embodiment as a leaf spring, which deforms when being overloaded.

The disposition of the dampers 22 in a damper cartridge 41 is advantageous in that the dampers can be exchanged as a module without requiring major mounting and adjusting work. Furthermore, the damper cartridges 41 may be combined according to door sizes and weights, wherein for example only one damper cartridge 41 with two dampers 22 is utilized for a small door, and a damper cartridge 41 with four dampers 22 is utilized for a large door. The hinge may thus be variably equipped for a plurality of differently dimensioned doors having different weights, and moreover no skilled personnel is required.

Figure 9:
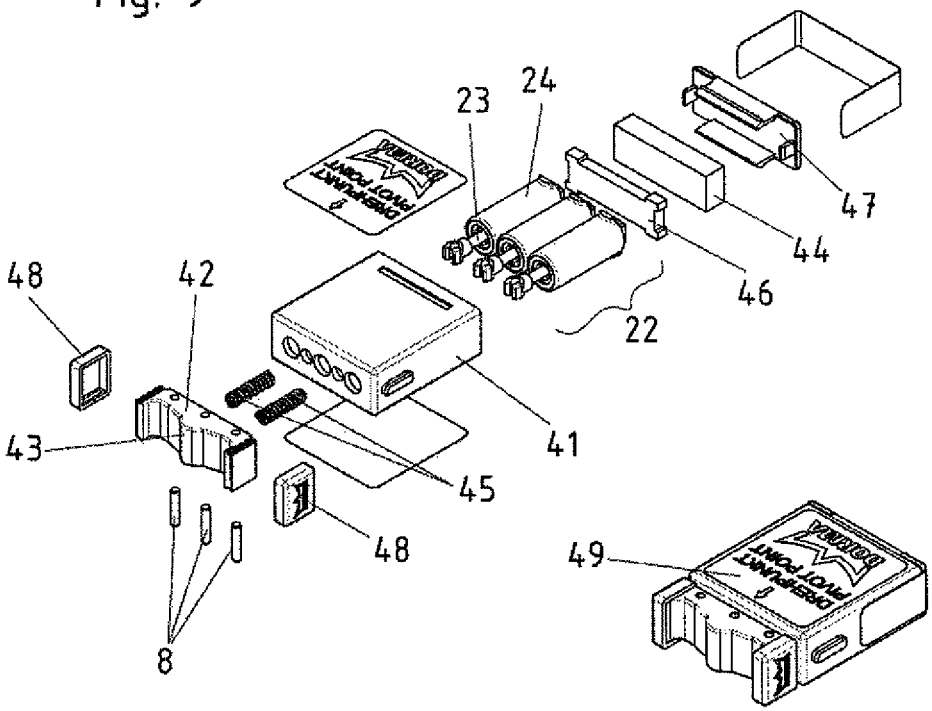
FIG. 9: is another embodiment of a damper cartridge.

Another embodiment of a disposition of the dampers 22 in a damper cartridge 41 is illustrated in FIG. 9. This embodiment shows three dampers 22 with their pistons 23 and cylinders 24 which are inserted into a damper cartridge 41. In this case again, the connection between the abutment 42 and the dampers 22 is realized via pins 8. Springs 45, which allow the pistons 23 to travel out of the cylinders 24, are disposed between the abutment 42 and the damper cartridge 41. Sliders 48, which ensure low friction guidance, are disposed laterally at the abutment 42. In this embodiment, the overload protection 44 is disposed behind the cylinder 24 between a deflector plate 46 and a closure 47. This embodiment shows an overload protection made from plastic material which deforms elastically. The cylinders 24, with their bottom, bear against the deflector plate 46. The closure 47 closes the damper cartridge 41. The abutment 42 mounted with the dampers 22 combined in the damper cartridge 41 results in a complete damper magazine 49, which, in different configurations, can be inserted into a hinge 1.

Figure 10:
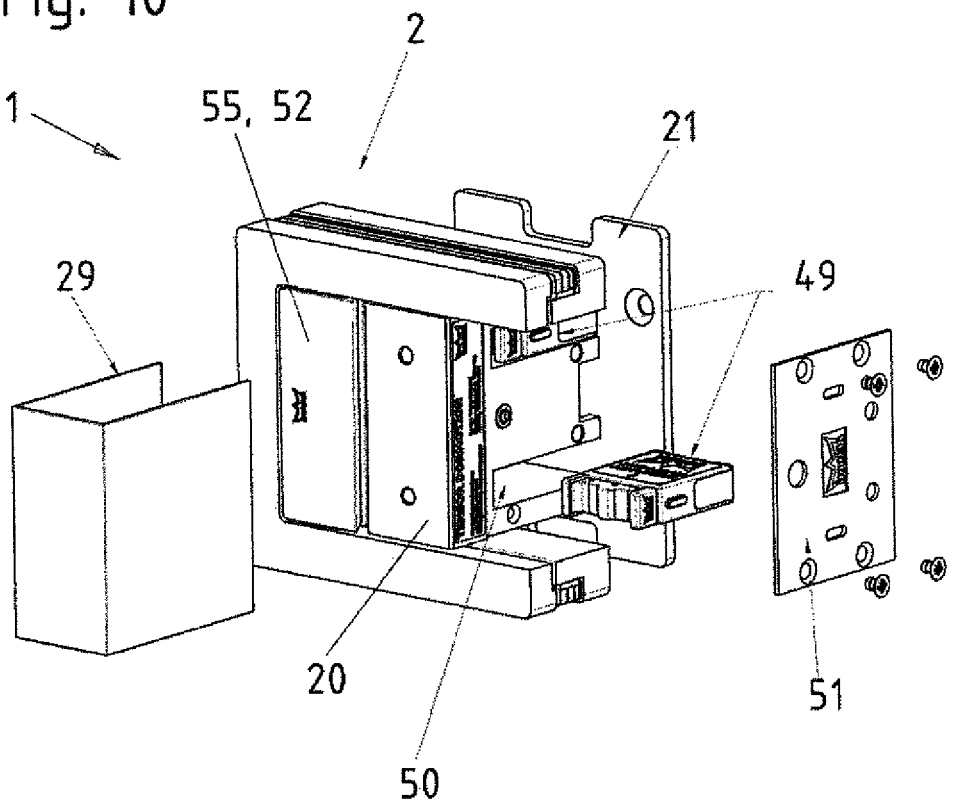
FIG. 10: is another embodiment of a joint hinge.

The hinge 1 according to FIG. 10 is pivoted by 90° to the side such that the frontal side of an angular bearing block 20 becomes visible. Once the cover cap 29 is removed, which in this embodiment encloses the bearing block in a U-shape on three sides, a cover 51 can be dismounted, behind which the at least one damper insert 50 is visible. This damper insert 50 is configured as an opening for inserting, respectively for removing a complete damper magazine 49. Thus, the hinge can be equipped with different dampers by a few manipulations such that an exchange of damaged dampers or an adaptation to different requirements is possible without any skilled personnel.

Figure 11:
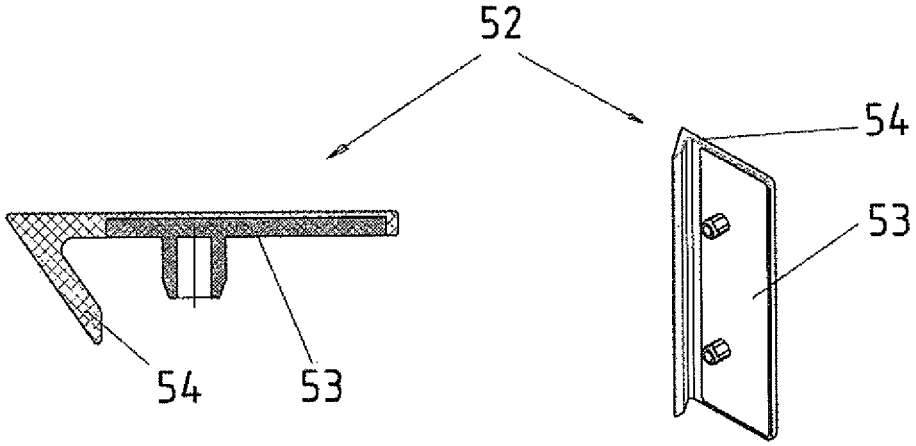
FIG. 11: is a detailed illustration of an abutment.

As the bearing block 20 has an angular contour in this embodiment, the risk of injury is given during a rotational movement if for example a finger gets into the gap 55 between the bearing block 20 and the leaf hinge portion 2. In order to cover the gap 55, the gap 55 is covered by an abutment 52, which according to FIG. 11 essentially consists of a support 53 and a buffer 54. The buffer 54 has an acute angle made from elastic material and is disposed with its tip oriented towards the bearing block 20. The gap 55 is thereby closed such as to avoid reaching into it. The geometrical configuration of the buffer 54 and its elastic behavior result in a visually completely closed hinge surface. In this case, the abutment 52 may consist of a composite material, wherein the support 53 may consist of hard material such as plastic material or metal, and the buffer 54 of soft material, such a rubber or plastic material.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A rotatably supported door comprising:

a door leaf:

a damping device configured as at least one of an opening and a closing damping device;

a hinge having a stationary hinge portion and a leaf hinge portion that is pivotable about the stationary hinge portion and coupled to the door leaf; and a rotating shaft passing through the stationary hinge portion and the leaf hinge portion, wherein the rotating shaft is an axis of rotation for the rotatably supported door that cooperates directly with the damping device to damp rotational movement of the rotatably supported door, wherein a fastening portion of the damping device fastened to the rotating shaft at a location that is offset from a longitudinal axis of the rotating shaft such that the fastening portion articulates about the longitudinal axis of the rotating shaft as the rotating shaft rotates, wherein the damping device comprises at least one damper that cooperates with and is disposed at the rotating shaft and a damper cartridge in which the at least one damper is disposed, wherein the damper cartridge has an abutment that cooperates with the rotating shaft, and further comprising an overload protection disposed at the abutment and configured to prevent the damping device from being damaged by deforming when overloaded, wherein the overload protection is one of a leaf spring or an elastic plastic material component.

2. The rotatably supported door according to claim 1, wherein the hinge has a least one of a hold-open and a hold-closed function.

3. The rotatably supported door according to claim 1, wherein the door is rotatably supported with one or more joint hinges.

4. The rotatably supported door according to claim 3 wherein the hinge and the one or more joint hinges are each configured as double-action hinges.

5. A hinge comprising a stationary hinge portion;

a leaf hinge portion which is pivotable about the stationary hinge portion; and a rotating shaft passing through the stationary hinge portion and the leaf hinge portion, wherein the rotating shaft cooperates directly with at least one damping device configured to damp rotational movement for at least one of opening and closing, wherein a fastening portion of the damping device is fastened to the rotating shaft at a location that is offset form a longitudinal axis of the rotating shaft such that the fastening portion articulates about the longitudinal axis of the rotating shaft as the rotating shaft rotates, wherein the at least one damping device comprises at least one damper that cooperates with and is disposed at the rotating shaft and a damper cartridge in which the at least one damper is disposed, wherein the damper cartridge has an abutment that cooperates with the rotating shaft, and further comprising an overload protection disposed at the abutment and configured to prevent the at least one damping device from being damaged by deforming when overloaded, wherein the overload protection is one of a leaf spring or an elastic plastic material component.

6. The hinge according to claim 5, wherein the damper includes a piston arranged in a cylinder that moves one of a fluid and a gas between two pressure compartments.

7. The hinge according to claim 5, wherein an end of the damper opposite the rotating shaft is attached to the stationary hinge.

8. The hinge according to claim 5, wherein the abutment cooperates with a cam that arranged on the rotating shaft.

9. The hinge according to claim 8, wherein the abutment has one of a flat, convex, and concave abutment surface.

10. The hinge according to claim 8, wherein the abutment is pressed against the cam.

11. The hinge according to claim 5, further comprising a latching device disposed at the rotating shaft and configured for at least one of a hold-open function and a hold-closed function.

12. The hinge according to claim 11, wherein the latching device is configured by a cam with a depression disposed at the rotating shaft that cooperates with a force-loaded roller.

13. The hinge according to claim 11, wherein each respective at least one damping device is disposed one above or below the latching device at the rotating shaft.

* * * * *